US007547086B2

(12) United States Patent
Tatsumi

(10) Patent No.: US 7,547,086 B2
(45) Date of Patent: Jun. 16, 2009

(54) RECORDING MEDIUM CONVEYANCE AMOUNT MEASUREMENT METHOD AND INKJET RECORDING APPARATUS

(75) Inventor: Setsuji Tatsumi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 52 days.

(21) Appl. No.: 11/606,128

(22) Filed: Nov. 30, 2006

(65) Prior Publication Data

US 2007/0126838 A1 Jun. 7, 2007

(30) Foreign Application Priority Data

Dec. 1, 2005 (JP) ..... 2005-348410

(51) Int. Cl.
*B41J 29/38* (2006.01)

(52) U.S. Cl. ..... 347/19; 347/116; 347/14

(58) Field of Classification Search ..... 347/19, 347/101, 104–107, 116
See application file for complete search history.

(56) References Cited

U.S. PATENT DOCUMENTS 5,287,162 A * 2/1994 de Jong et al. ..... 399/49
6,082,911 A * 7/2000 Murakami ..... 400/74
6,755,499 B2 * 6/2004 Castano et al. ..... 347/19
7,083,251 B2 * 8/2006 Kang et al. ..... 347/19
7,354,129 B2 * 4/2008 Uchida ..... 347/19

FOREIGN PATENT DOCUMENTS

JP 2004-17526 A 1/2004

* cited by examiner

*Primary Examiner*—Thinh H Nguyen
(74) *Attorney, Agent, or Firm*—Birch, Stewart, Kolasch & Birch, LLP

(57) ABSTRACT

The recording medium conveyance amount measurement method includes the steps of: recording a first test pattern having two straight lines including at least one straight line which is not parallel with respect to a conveyance direction of a recording medium and a direction perpendicular to the conveyance direction, onto the recording medium; conveying the recording medium in the conveyance direction; recording a second test pattern having two straight lines including at least one straight line which is not parallel with respect to the conveyance direction of the recording medium and the direction perpendicular to the conveyance direction, onto the recording medium; and reading in the first and second test patterns and calculating a conveyance amount of the recording medium.

12 Claims, 10 Drawing Sheets

IN THE CASE OF
NO FEED ERROR

IN THE CASE OF
FEED ERROR

RECORDING MEDIUM CONVEYANCE AMOUNT MEASUREMENT METHOD AND INKJET RECORDING APPARATUS

BACKGROUND OF THE INVENTION

Field of the Invention

The present invention relates to a recording medium conveyance amount measurement method and an inkjet recording apparatus, and more particularly, to a recording medium conveyance amount measurement method and an inkjet recording apparatus using same for measuring and calculating the deviation in the feed amount of a recording medium in the sub-scanning direction, in a serial (shuttle) type of inkjet recording apparatus.

Description of the Related Art

An inkjet recording apparatus is known, which comprises an inkjet head having an arrangement of a plurality of nozzles that eject ink in the form of droplets and which records images on a recording medium by ejecting ink from the nozzles toward the recording medium while causing the inkjet head and the recording medium to move relatively to each other.

For the print method used in an inkjet recording apparatus, there is a so-called serial print method or a shuttle print method. This is a method which records an image on a recording medium by repeating a process of printing one band portion of an image in a direction perpendicular to the conveyance direction of the recording medium (in other words, in the breadthways direction of the recording medium) by ejecting ink while moving the inkjet head reciprocally in the breadthways direction of the recording medium, and then conveying the recording medium through a distance corresponding to one band portion, and printing the next band portion of the image while moving the inkjet head reciprocally again.

Consequently, in an inkjet recording apparatus of this kind, if there is an error in the amount of conveyance of the recording medium (namely, deviation in the sub-scanning feed amount), then gaps and white stripes may appear at a join between bands, or bands may overlap with each other and produce increased density, or the like, thus giving rise to a streaky unevenness in the breadthways direction of the recording medium (main scanning direction). Therefore, in order to adjust the amount of conveyance of the recording medium, it is important that the conveyance error (sub-scanning feed amount deviation) of the recording medium be determined with good accuracy.

In response to this, for example, Japanese Patent Application Publication No. 2004-17526 discloses a determination print pattern printing method and an inkjet image forming apparatus in which a straight line-shaped image extending in the scanning direction (namely, the main scanning direction) of the print head (inkjet head) is recorded before and after a sub-scanning feed action of the print material (recording medium). In this apparatus, the sub-scanning feed amount deviation is determined on the basis of the state of matching, in terms of the sub-scanning direction, between the edge portions of the images recorded before and after the feed action. In this method, it is possible to recognize the deviation in the sub-scanning feed amount of the recording medium by enlarging the amount of deviation by performing a sub-scanning feed action a plurality of times, and thus it is easy to determine the amount of deviation.

However, in the method and apparatus described in Japanese Patent Application Publication No. 2004-17526, if the sub-scanning feed deviation is determined by using a straight line-shaped image extending in the main scanning direction, then the edge sections which are important for the determination are formed by droplets ejected from one nozzle. Consequently, if there is an ejection defect, such as a direction or size abnormality, or an ejection failure, in that nozzle, then a further error may be included, in addition to the basic amount of deviation, in the result of the determination.

Furthermore, if the amount of deviation is determined automatically by using a sensor row attached to a carriage, then since the sensor which determines the edge section would be one element only, the results are subject to the effects of a sensitivity non-uniformity in the sensor, and the like, and therefore it may not be possible to measure the amount of deviation accurately. Although sensors are calibrated by reading a white sheet, sensitivity non-uniformities occur often as a result of dirt adhering to the white sheet.

Moreover, in the method and apparatus described in Japanese Patent Application Publication No. 2004-17526, the determination is made easier by enlarging the amount of deviation by performing a sub-scanning feed action a plurality of times; however, if the print speed is to be increased, then it is necessary to reduce as much as possible the number of multiple writing actions by increasing the sub-scanning feed amount per feed action. Therefore, if, for example, the feed amount per feed action is set to ½ of the length of the head, then it is not possible to enlarge the amount of deviation by setting the feed amount to be repeated a plurality of times when printing the test pattern.

SUMMARY OF THE INVENTION

The present invention is contrived in view of these circumstances, an object thereof being to provide a recording medium conveyance amount measurement method and an inkjet recording apparatus in order that the sub-scanning feed amount can be determined accurately by means of a sensor.

In order to attain the aforementioned object, the present invention is directed to a recording medium conveyance amount measurement method, comprising the steps of: recording a first test pattern having two straight lines including at least one straight line which is not parallel with respect to a conveyance direction of a recording medium and a direction perpendicular to the conveyance direction, onto the recording medium; conveying the recording medium in the conveyance direction; recording a second test pattern having two straight lines including at least one straight line which is not parallel with respect to the conveyance direction of the recording medium and the direction perpendicular to the conveyance direction, onto the recording medium; and reading in the first and second test patterns and calculating a conveyance amount of the recording medium.

According to this aspect of the present invention, it is possible to measure the conveyance amount of the recording medium accurately.

Preferably, the conveyance amount of the recording medium is calculated by calculating a first intersection point of the two straight lines constituting the first test pattern and a second intersection point of the two straight lines constituting the second test pattern, and calculating a distance in the conveyance direction between the first and second intersection points.

According to this aspect of the present invention, by calculating intersection points of the straight lines and calculating the conveyance amount in this way, the measurement accuracy of the conveyance amount is further improved.

In order to attain the aforementioned object, the present invention is also directed to an inkjet recording apparatus, comprising: a conveyance device which conveys a recording medium; an ejection device which ejects liquid toward the recording medium while moving in a direction perpendicular to a conveyance direction of the recording medium; a test pattern generation device which generates a first test pattern and a second test pattern, each having two straight lines including at least one straight line which is not parallel with respect to the conveyance direction of the recording medium and a direction perpendicular to the conveyance direction; a reading device which reads in the first test pattern and the second test pattern formed on the recording medium; and a feed deviation amount calculation device which calculates a feed deviation amount of the recording medium in the conveyance direction according to results of reading in the first test pattern and the second test pattern by the reading device, wherein the recording medium is conveyed in the conveyance direction after the first test pattern is formed on the recording medium, the second test pattern is then formed on the recording medium, and the feed deviation amount of the recording medium in the conveyance direction is calculated according to the results of reading in the first test pattern and the second test pattern.

According to this aspect of the present invention, it is possible to accurately calculate the amount of deviation in the feed of the recording medium in the inkjet recording apparatus.

Preferably, the feed deviation amount calculation device calculates a first intersection point of the two straight lines constituting the first test pattern and a second intersection point of the two straight lines constituting the second test pattern according to the results of reading in the first test pattern and the second test pattern by the reading device, and calculates the feed deviation amount according to a distance in the conveyance direction between the first and second intersection points.

According to this aspect of the present invention, it is possible to further improve the calculation accuracy of the amount of feed deviation.

Preferably, the inkjet recording apparatus further comprises: a medium type identification device which identifies a type of the recording medium; a print mode setting device which sets a print mode; and a conveyance amount setting device which sets the conveyance amount of the recording medium according to the type of the recording medium, the print mode, and calculation results of the feed deviation amount calculation device.

According to this aspect of the present invention, it is possible to convey the recording medium accurately on the basis of the amount of feed deviation, and the like, and therefore high-precision image recording can be achieved.

As described above, according to the present invention, it is possible to measure the conveyance amount of the recording medium accurately.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

Figure 1:
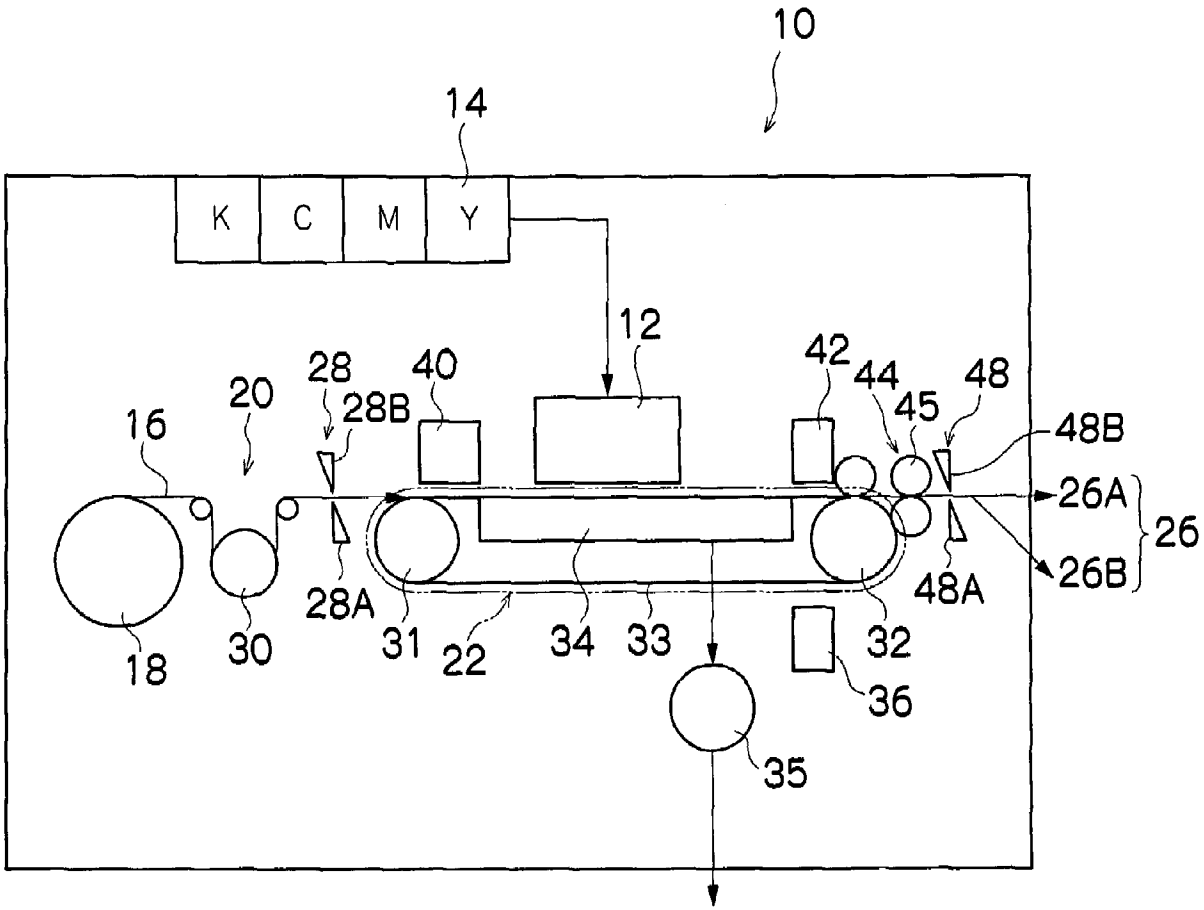
FIG. 1 is a general schematic drawing of an embodiment of an inkjet recording apparatus using a recording medium conveyance amount measurement method relating to an embodiment of the present invention.

FIG. 1 is a general schematic drawing of an embodiment of an inkjet recording apparatus using a recording medium conveyance amount measurement method relating to an embodiment of the present invention.

As shown in FIG. 1, the inkjet recording apparatus 10 comprises: a print unit 12 which performs shuttle-method printing and has a plurality of print heads provided for respective ink colors; an ink storing and loading unit 14 for storing inks to be supplied to the print unit 12; a paper supply unit 18 for supplying recording paper 16; a decurling unit 20 for removing curl in the recording paper 16 supplied from the paper supply unit 18; a suction belt conveyance unit 22 disposed facing the nozzle faces (ink ejection faces) of the respective print heads of the print unit 12, for conveying the recording paper 16 while keeping the recording paper 16 flat; and a paper output unit 26 for outputting printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper be attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle faces of the printing unit 12 forms a plane (flat plane).

The belt 33 has a width that is greater than the width of the recording paper 16, and a plurality of suction restrictors (not shown) are formed on the belt surface. A suction chamber 34 is disposed in a position facing the nozzle faces of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction. The belt 33 is driven in the clockwise direction in FIG. 1 by the motive force of a motor (not illustrated) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 comprises print heads corresponding to inks of respective colors which move back and forth reciprocally in the direction perpendicular to the conveyance direction of the recording paper 16 (sub-scanning direction), in other words, in the main scanning direction. The print unit 12 performs printing based on a shuttle method. The print unit 12 is described in detail below.

As shown in FIG. 1, the ink storing and loading unit 14 has tanks for storing inks of colors corresponding to the respective print heads in the print unit 12, and each tank is connected to a print head by means of a channel (not illustrated). Moreover, the ink storing and loading unit 14 also comprises a notifying device (display device, alarm generating device, or the like) for generating a notification if the remaining amount of ink has become low, and a mechanism for preventing incorrect loading of ink of the wrong color.

A post-drying unit 42 is disposed following the print determination unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print (test pattern) which is described later are preferably outputted separately. In the inkjet recording apparatus 10, a sorting device (omitted in drawings) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Figure 2:
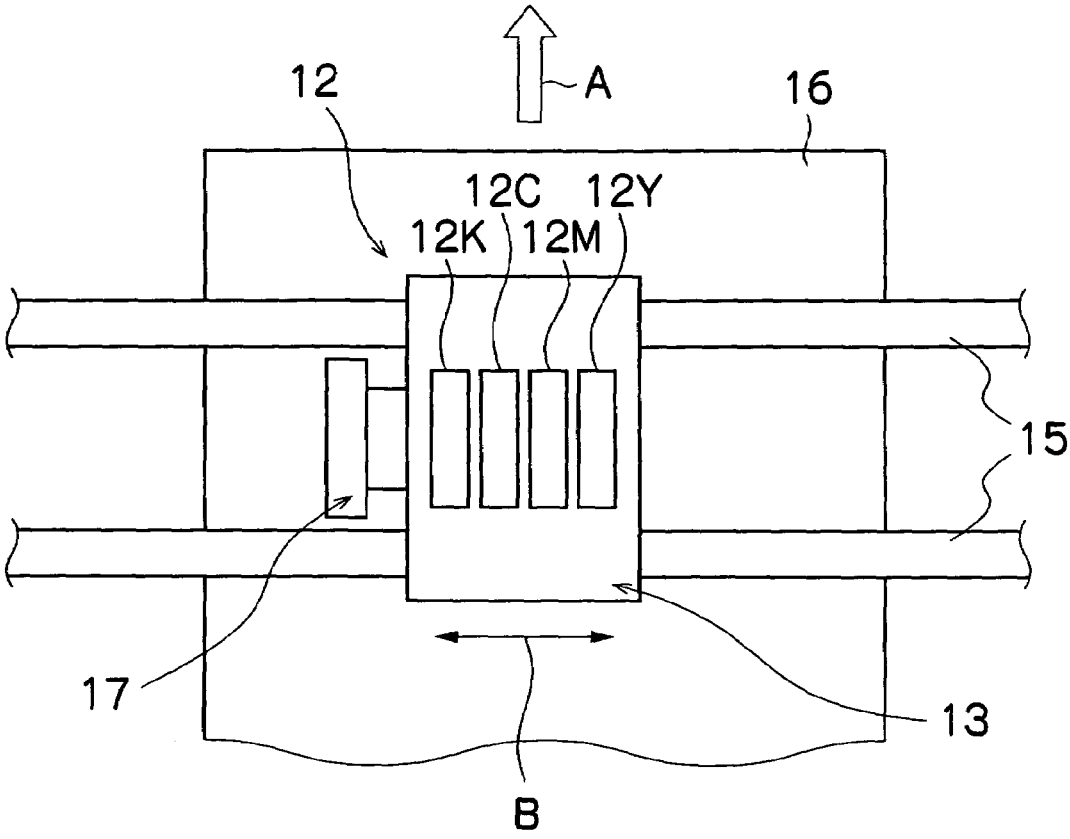
FIG. 2 is a plan diagram showing an enlarged view of the periphery of a print unit of the inkjet recording apparatus according to an embodiment of the invention.

FIG. 2 is a plan diagram showing an enlarged view of the periphery of the print unit 12 of the inkjet recording apparatus 10 according to the present embodiment.

As shown in FIG. 2, the print unit 12 has a print head 12Y which ejects yellow (Y) ink, a print head 12M which ejects magenta (M) ink, a print head 12C which ejects cyan (C) ink and a print head 12K which ejects black (K) ink. The print heads 12Y, 12M, 12C and 12K are arranged in alignment on a head carriage 13 in such a manner that their lengthwise direction is substantially parallel to the conveyance direction of the recording paper 16 (indicated by arrow A).

As indicated by the arrow B in FIG. 2, the head carriage 13 can move reciprocally back and forth over guide rails 15 situated in the breadthways direction (main scanning direction) of the recording paper 16 which is substantially perpendicular to the conveyance direction of the recording paper 16 (sub-scanning direction). The print heads 12Y, 12M, 12C and 12K are shuttle-type heads which perform image recording while moving back and forth reciprocally in the breadthways direction of the recording paper 16 (the direction indicated by arrow B in FIG. 2) along with the movement of the carriage 13.

According to this structure, the print heads 12Y, 12M, 12C and 12K perform image recording only when moving in one direction from the left-hand end of the recording paper 16 towards the right-hand end, in the diagram, and they do not perform image recording when returning back to the left-hand end after reaching the right-hand end.

Furthermore, the recording paper 16 remains still while the print heads 12Y, 12M, 12C and 12K are moving while recording from one end toward the other end in the breadthways direction of the recording paper 16 (in the embodiment shown in FIG. 2, from the left-hand end to the right-hand end). When the print heads 12Y, 12M, 12C and 12K have finished recording from one end (first end) of the recording paper 16 in the breadthways direction to the other end (second end), and are then returning back to the first end, the recording paper 16 is conveyed in the sub-scanning direction as indicated by the arrow A in FIG. 2 through a distance corresponding to the width of the band-shaped image recording region extending in the breadthways direction of the recording paper 16 which has just been recorded by the print heads 12Y, 12M, 12C and 12K.

Furthermore, a scanner unit 17 which reads in an image recorded on the recording paper 16 is provided on the left-hand side of the carriage 13 (in terms of the diagram). The scanner unit 17 is a line sensor in which a row of sensors is arranged following the conveyance direction of the recording paper 16. The sensor coverage region of the scanner unit 17 is slightly broader than the length of the nozzle rows of the respective print heads 12Y, 12M, 12C and 12K. Consequently, even if there is an installation error in the scanner unit 17, it is still able to cover all of the nozzles.

Figure 3:
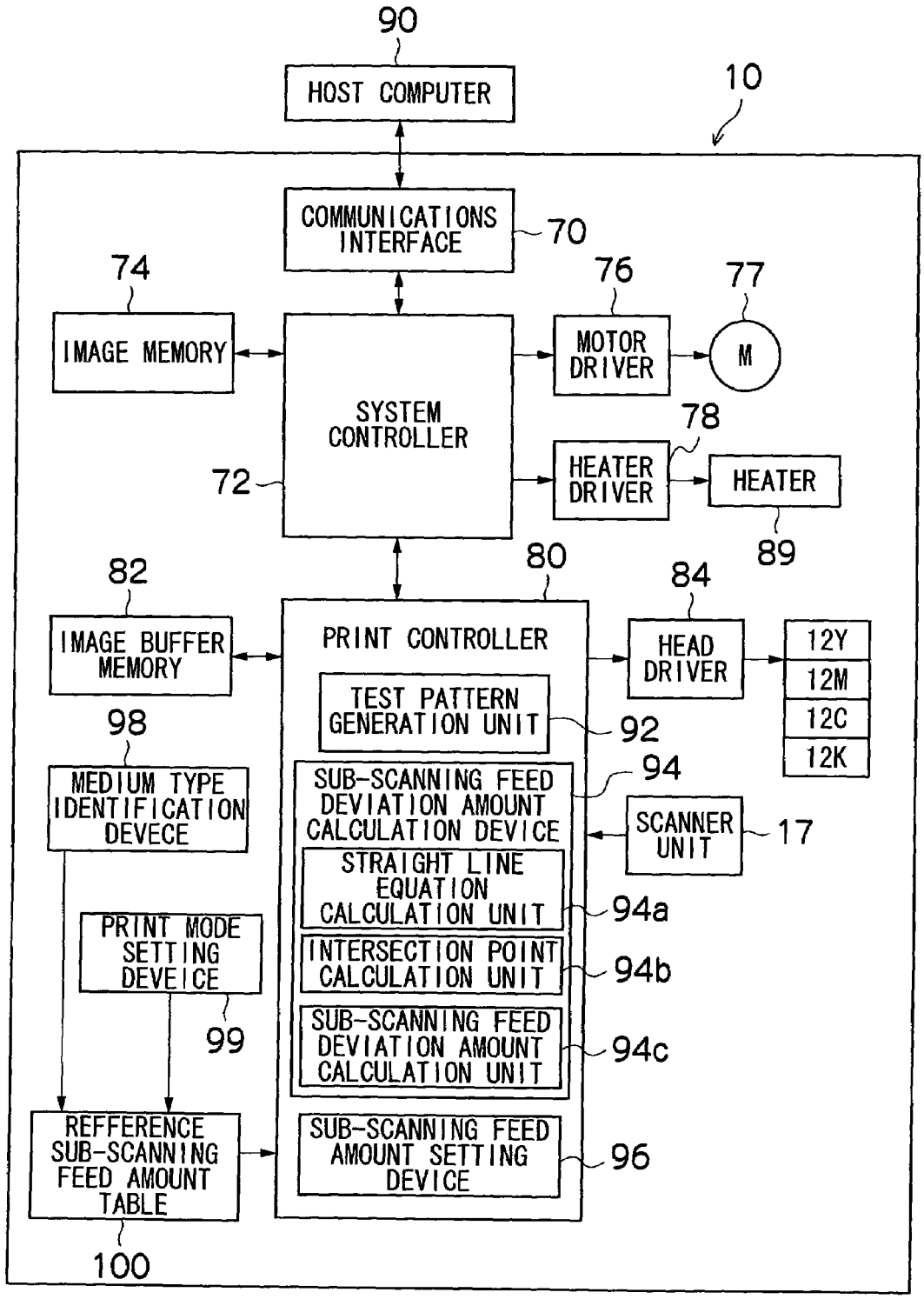
FIG. 3 is a partial block diagram showing the system composition of an inkjet recording apparatus according to an embodiment of the present invention.

FIG. 3 is a principal block diagram showing the system configuration of the inkjet recording apparatus 10.

As shown in FIG. 3, the inkjet recording apparatus 10 of the present embodiment comprises a communications interface 70, a system controller 72, an image memory 74, a motor driver 76, a heater driver 78, a print controller 80, an image buffer memory 82, a head driver 84, and the like.

The communications interface 70 is an interface unit for receiving image data sent from a host computer 90. A serial interface such as USB, IEEE1394, Ethernet, wireless network, or a parallel interface such as a Centronics interface may be used as the communications interface 70. A buffer memory may be mounted in this portion in order to increase the communication speed.

The image data sent from the host computer 90 is received by the inkjet recording apparatus 10 through the communications interface 70, and is temporarily stored in the image memory 74. The image memory 74 is a storage device for temporarily storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communications interface 70, image memory 74, motor driver 76, heater driver 78, and the like, and controls communications with the host computer 90 and writing and reading to and from the image memory 74, and it also generates control signals for controlling the motor 77 and heater 89 of the conveyance system.

The program executed by the CPU of the system controller 72 and the various types of data which are required for control procedures are stored in the ROM (omitted in the drawings) or the like. The image memory 74 is used as a temporary storage region for the image data, and it is also used as a program development region and a calculation work region for the CPU.

The motor driver 76 is a driver (drive circuit) that drives the motor 77 of the conveyance system that conveys the recording paper 16 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84.

The print controller 80 is provided with the image buffer memory 82; and image data, parameters, and other data are temporarily stored in the image buffer memory 82 when image data is processed in the print controller 80. The aspect shown in FIG. 3 is one in which the image buffer memory 82 accompanies the print controller 80; however, the image memory 74 may also serve as the image buffer memory 82. Also possible is an aspect in which the print controller 80 and the system controller 72 are integrated to form a single processor.

The image data to be printed is externally inputted through the communications interface 70, and is stored in the image memory 74. In this stage, for example, the RGB image data is stored in the image memory 74.

The image data stored in the image memory 74 is sent to the print controller 80 through the system controller 72, and is converted to the dot data for each ink color by a half-toning technique, such as dithering or error diffusion, in the print controller 80. In this inkjet recording apparatus 10, an image which appears to have continuous tonal graduations to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible.

In other words, the print controller 80 performs processing for converting the input RGB image data into dot data for the four colors of Y, M, C and K. Furthermore, the print controller 80 judges the droplet ejection region of the treatment liquid (the region of the recording surface where ejection of treatment liquid is required) on the basis of the dot data of the respective colors, and thus generates dot data for the ejection of treatment liquid droplets. The dot data (for the treatment liquid and the respective colors) generated by the print controller 80 is stored in the image buffer memory 82.

The head driver 84 generates drive control signals for the print heads 12Y, 12M, 12C and 12K of the respective ink colors, on the basis of the print data supplied from the print controller 80 (in other words, the dot data stored in the image buffer memory 82).

The drive control signals generated by the head driver 84 are applied to the actuators for ink ejection of the print heads 12Y, 12M, 12C and 12K, thereby causing ink to be ejected from nozzles of the print heads 12Y, 12M, 12C and 12K.

As described above, the recording paper 16 is halted and the ink is ejected from the print heads 12Y, 12M, 12C and 12K while the print heads 12Y, 12M, 12C and 12K are being moved from one end section and the other end section in the breadthways direction of the recording paper 16 (see FIG. 2). Thereupon, the recording paper 16 is conveyed in the sub-scanning direction through a distance corresponding to the nozzle length (the range through which nozzles are formed in the sub-scanning direction of each of the print heads), the print heads 12Y, 12M, 12C and 12K return from the other end to the first end, the recording paper 16 is halted again, and ink is ejected while the print heads 12Y, 12M, 12C and 12K are being moved toward the other end. By repeating this operation, an image is formed on the recording paper 16.

Furthermore, in the present embodiment, the print controller 80 also comprises: a test pattern generation unit 92 which generates print data of a test pattern for determining the amount of sub-scanning feed deviation (the error in the feed distance of the recording paper 16 in the sub-scanning direction) in order to determine the amount of sub-scanning feed deviation; a sub-scanning feed deviation amount calculation device 94 which calculates the amount of sub-scanning feed deviation on the basis of the results of reading in a printed test pattern by means of a scanner unit 17; a sub-scanning feed amount setting device (conveyance amount setting device) 96 which sets the sub-scanning feed amount (conveyance amount) on the basis of the calculated sub-scanning feed deviation amount; and the like.

Although described in detail below, the test pattern comprises two straight lines which are not parallel with either the main scanning direction or the sub-scanning direction, for example, the position of the intersection point between these two straight lines is found, and the sub-scanning feed deviation amount is calculated according to the position of the intersection point between these two straight lines. Therefore, the sub-scanning feed deviation amount calculation device 94 comprises a straight line equation calculation unit 94*a*, an intersection point calculation unit 94*b* and a sub-scanning feed amount calculation unit 94*c*.

Furthermore, the sub-scanning feed amount setting device 96 is used in setting the sub-scanning feed amount. Hence, a medium type identification device 98 which identifies the type of recording medium 16, a print mode setting device 99 and a reference sub-scanning feed amount table 100 are provided with the print controller 80.

Next, a method of calculating the sub-scanning feed deviation amount is described, as a method of measuring the conveyance amount of the recording medium according to an embodiment of the present invention.

Figure 4:
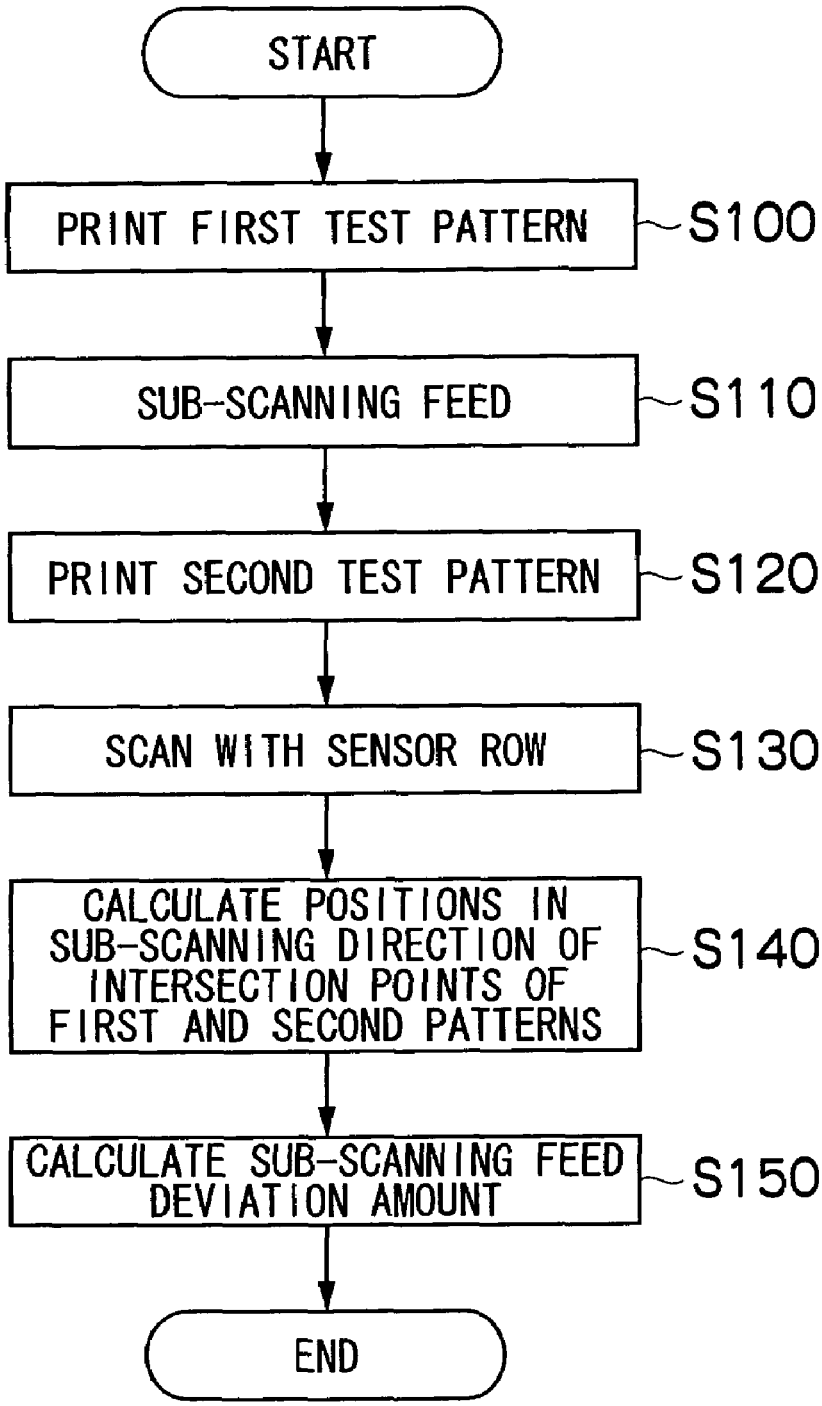
FIG. 4 is a flowchart showing the sequence of a method for calculating the sub-scanning feed deviation amount, relating to an embodiment of the present invention.

FIG. 4 shows a flowchart indicating the general sequence of a method for calculating the sub-scanning feed deviation amount, relating to the present embodiment.

Firstly, in step S100 in FIG. 4, a first test pattern is printed. The print data for the first test pattern is generated by the test pattern generation unit 92.

Figure 5:
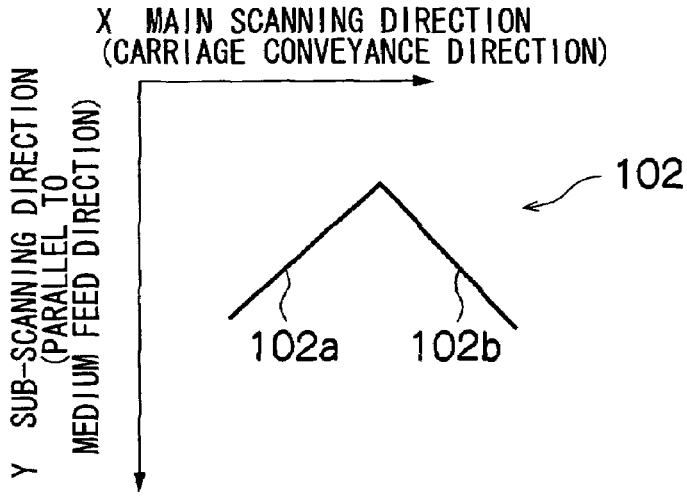
FIG. 5 is an illustrative diagram showing an embodiment of a test pattern.

FIG. 5 shows an embodiment of a first test pattern. As shown in FIG. 5, the first test pattern 102 is constituted by two straight lines, a first straight line (first line) 102*a* and a second straight line (second line) 102*b*. These two straight lines 102*a* and 102*b* are not parallel to either the sub-scanning direction, which is parallel to the conveyance direction of the recording paper 16, or the main scanning direction, which is the conveyance direction of the head carriage 13 and which runs perpendicularly with respect to the sub-scanning direction.

A brief description is now given with respect to why a test pattern of this kind is used. Firstly, in order to find the feed error in the sub-scanning direction, it is necessary to record a test pattern, to record the test pattern again after feeding the medium in the sub-scanning direction, and to then determine the relative positions (coordinates) in the y direction (sub-scanning direction) on the recording medium 16, of particular locations of the test patterns recorded before and after sub-scanning feeding.

Figure 6:
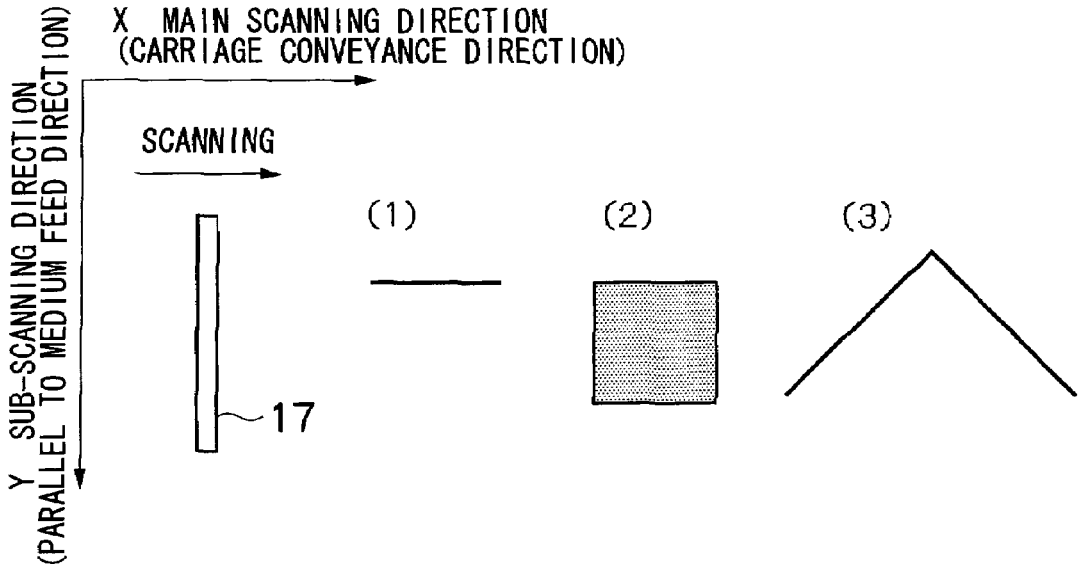
FIG. 6 is an illustrative diagram showing the beneficial effects of the test pattern according to an embodiment of the present invention.

In this case, as shown in FIG. 6, scanning is performed by moving a scanner unit 17 comprising sensor elements (determination elements) arranged in a single row, over a printed test pattern, in parallel with the main scanning direction.

Here, in the case of a pattern including one line printed in the main scanning direction by one nozzle as shown in (1) in FIG. 6, for example, since only one nozzle is used, then if there is an ejection defect, such as a landing position displacement, in this nozzle, it is not is possible to measure the y direction coordinates of the patterns accurately.

Furthermore, in the case of a test pattern including a square shape having edges parallel to the main scanning direction as shown in (2) in FIG. 6, although the edge positions of the two edges parallel to the main scanning direction are determined by the sensors, this is simply equivalent to providing two of the patterns shown in (1) above, and therefore, similarly to the case of (1), if there is an ejection defect in the nozzle which prints the edge sections, it is not possible to measure the y direction coordinates of the patterns accurately.

Furthermore, since the scanning direction of the line sensor of the scanner unit 17 coincides with the edge direction of the pattern, then the edge portion is identified by approximately one determination element of the sensor only, and if there is a sensitivity deviation in this sensor element, then deviation occurs in the threshold value judgment of the scanned edge, because of loss of focus caused by flaring or the like, and hence it is difficult to measure the y-direction coordinates of the edges accurately.

In contrast to this, in the case of a test pattern such as that shown in (3) in FIG. 6 which includes two straight lines which are not parallel to either the main scanning direction or the sub-scanning direction, the coordinates of the point of intersection of the two straight lines is determined by reading in the two straight lines and performing a calculation, and hence the coordinates of the point of intersection can be determined accurately. By recording two test patterns of this kind, one before and one after feeding in the sub-scanning direction, and by comparing the coordinates of the points of intersection in these test patterns, it is possible to determine the amount of sub-scanning feed deviation accurately.

The test pattern is not limited to a pattern constituted by two straight lines which are not parallel to either the main scanning direction or the sub-scanning direction, as shown in FIG. 5. It is not an essential requirement that the lines must not be parallel to either the main scanning direction or the sub-scanning direction, but the pattern should contain two straight lines which are not mutually parallel.

Figure 7A:
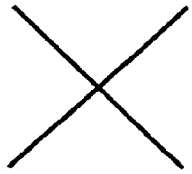
FIGS. 7A to 7D are illustrative diagrams showing further embodiments of test patterns.
Figure 7B:
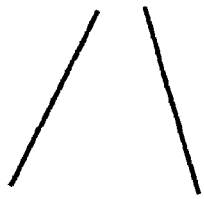
Figure 7C:
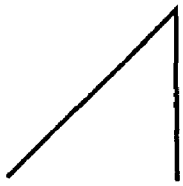
Figure 7D:
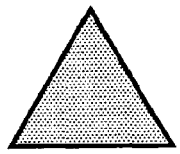

FIGS. 7A to 7D show further embodiments of a test pattern. For instance, the embodiment in FIG. 7A comprises two straight lines which intersect mutually, and the embodiment in FIG. 7B comprises two straight lines which do not intersect but which would intersect mutually if they are extended more. Moreover, the embodiment in FIG. 7C is similar to the pattern in FIG. 5, but one of the straight lines is parallel to the sub-scanning direction. Furthermore, the embodiment in FIG. 7D is a figure which has at least one set of edges which are not parallel to the main scanning direction, and whose interior is filled with a solid image. In this case also, by determining the set of non-parallel edges, it is possible to treat the pattern similarly to one constituted by straight lines. The edges of the figure whose interior is filled with a solid image can be regarded as being included in straight lines.

Figure 8:
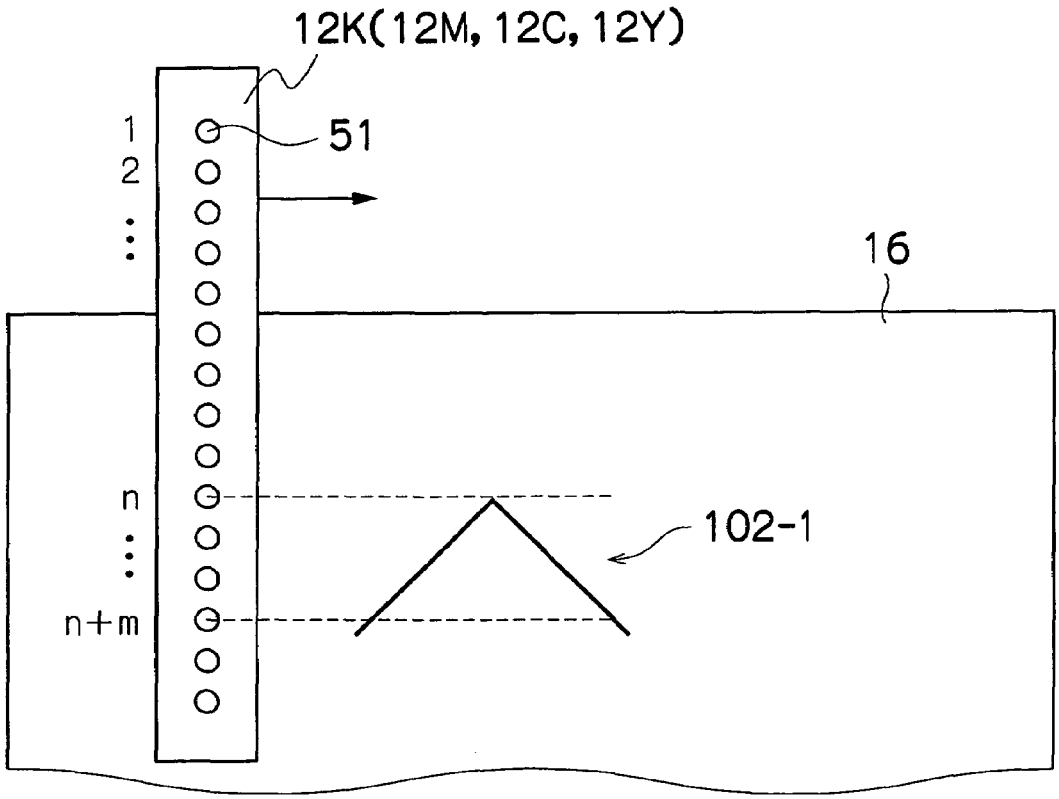
FIG. 8 is a plan diagram showing a situation of printing a first test pattern.

A pattern such as that described above is printed onto the recording paper 16 as a first test pattern. In other words, as shown in FIG. 8, the pattern shown in FIG. 5 is recorded onto the recording paper 16 as a first test pattern 102-1 while the print head (one of 12Y, 12M, 12C and 12K) is being moved in the breadthways direction of the recording paper 16 (a direction perpendicular to the conveyance direction of the recording paper 16 (sub-scanning direction)). In this way, the first test pattern 102-1 is constituted by two line segments respectively having angles of 45° and −45° with respect to the main scanning direction, and these line segments intersect with each other at their respective end points.

In this case, the print head 12K (or any of 12Y, 12M and 12C) has nozzles 51 arranged in one row in the sub-scanning direction. Furthermore, numbers (1, 2, . . . , n, . . . ) are assigned to the nozzles 51 from the upper side in the diagram, and the first test pattern 102-1 is formed by droplets ejected by the (m+1) nozzles 51 from the nth nozzle to the (n+m)th nozzle.

Figure 9:
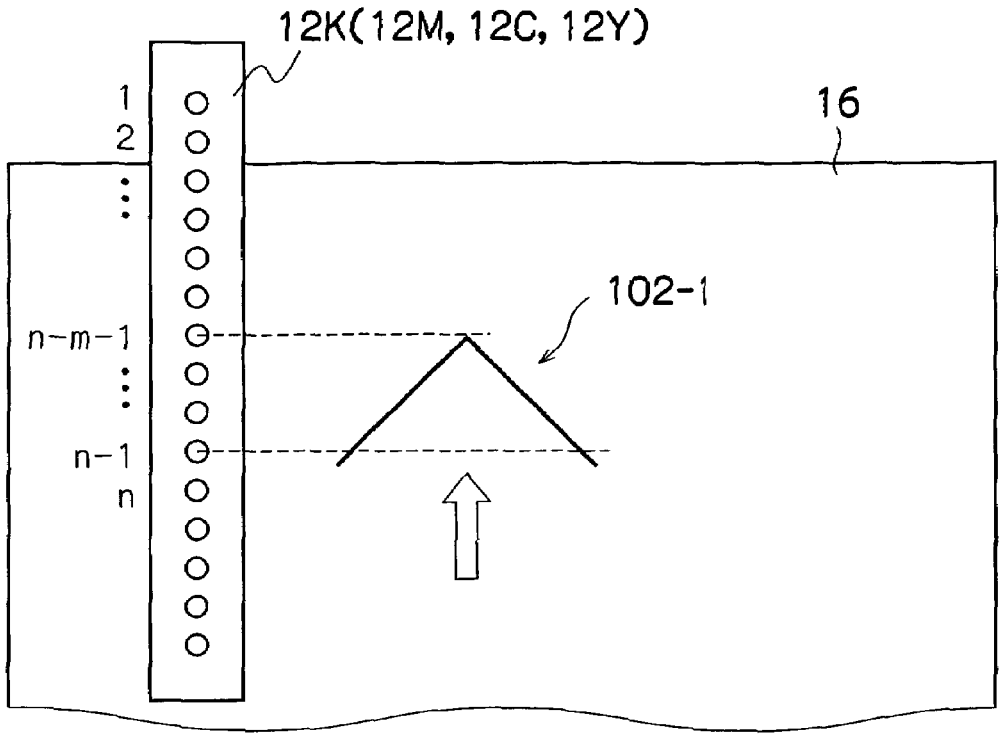
FIG. 9 is a plan diagram showing a situation of sub-scanning feeding of a first test pattern.

Next, at step S110 in FIG. 4, as shown in FIG. 9, the recording paper 16 is fed (conveyed) in the sub-scanning direction by a distance corresponding to the length (height) in the y direction of the first test pattern 102-1, in other words, through a distance corresponding to m+1 nozzles.

Figure 10:
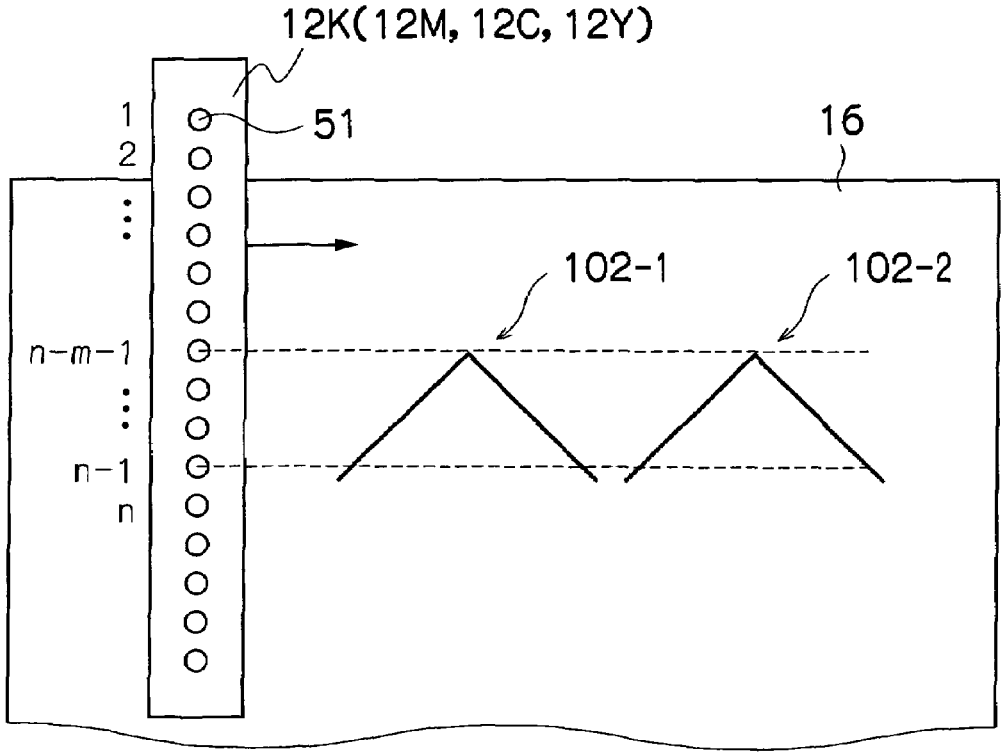
FIG. 10 is a plan diagram showing a situation of printing a second test pattern after sub-scanning feed.

Next, at step S120, as shown in FIG. 10, a second test pattern 102-2 is printed to the right-hand side of the first test pattern 102-1 by means of the (n−m−1)th to the (n−1)th nozzles 51, while the print head 12K (12C, 12M, 12Y) is being moved in the breadthways direction of the recording paper 16.

The first test pattern 102-1 and the second test pattern 102-2 do not necessarily have to be the same pattern, but in the embodiment shown here, the second test pattern 102-2 is the same as the first test pattern 102-1.

Furthermore, each of the patterns is printed by performing a single scan of the print head 12K (12C, 12M, 12Y) from one end to the other end in the breadthways direction of the recording paper 16. This is because, when reciprocal printing or printing using a plurality of passes is performed, deviation occurs in the x direction (main scanning direction) between the passes, and hence error occurs in the calculation of the coordinates of the point of intersection between the two straight lines.

Furthermore, the line width of the straight lines which constitute each pattern may be one dot, but if measurement by the sensor is difficult because of flare, then the line width may be constituted by a several dots.

Next, at step S130, the first test pattern 102-1 and the second test pattern 102-2 are scanned by the sensor row of the scanner unit 17. Since the scanner unit 17 is disposed on the head carriage 13, then it is possible to scan the patterns simultaneously with the recording of the second test pattern 102-2, while the head carriage 13 is being moved.

The data read in by the scanner unit 17 is sent to the sub-scanning feed deviation amount calculation device 94 of the print controller 80.

Figure 11:
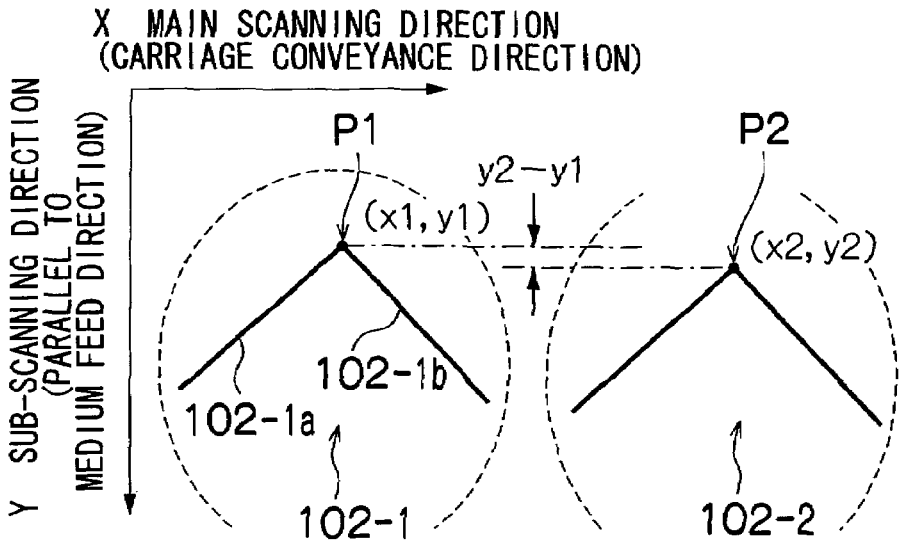
FIG. 11 is an illustrative diagram showing a method of calculating a sub-scanning feed deviation amount.

In step S140, as shown in FIG. 11, the sub-scanning direction positions y1 and y2 of the respective points of intersections P1 and P2 of the two sets of two straight lines which respectively constitute the first test pattern 102-1 and the second test pattern 102-2 are calculated. Thereupon, at step S150, the sub-scanning feed deviation amount is calculated by comparing the sub-scanning direction positions y1 and y2 of the respective points of intersection P1 and P2.

Figure 12:
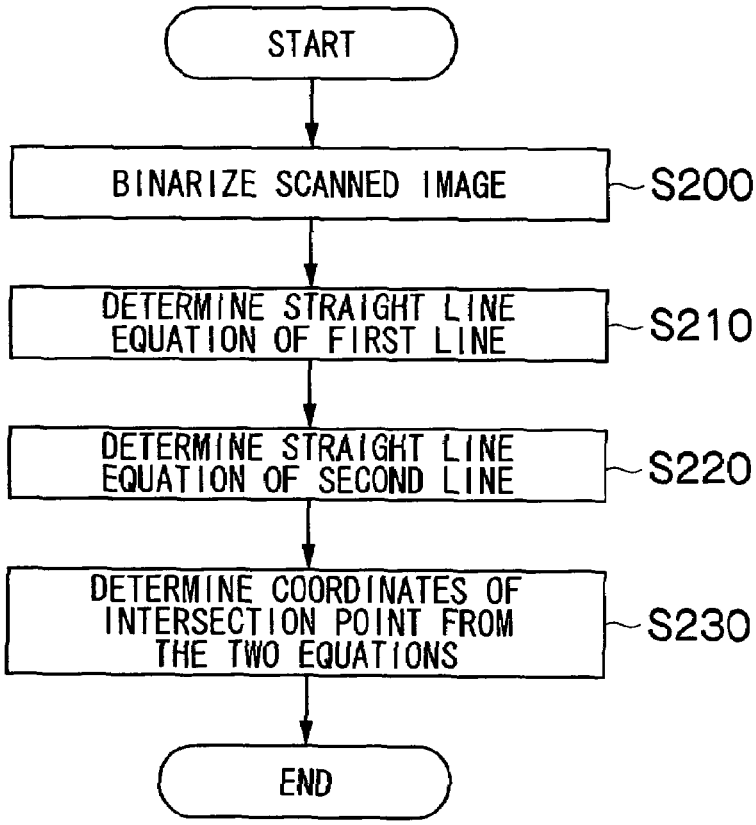
FIG. 12 is a flowchart showing a sequence of determining a point of intersection of two straight lines constituting a test pattern.

Next, the method of determining a point of intersection of the two straight lines is described. FIG. 12 shows a flowchart which indicates a method of determining a point of the intersection. The method of determining the point of intersection is the same for both the first test pattern 102-1 and the second test pattern 102-2, and therefore the method of determining the point of intersection in the first test pattern 102-1 is described here.

Firstly, at step S200 in FIG. 12, the scanned image of the first test pattern 102-1 sent from the scanner unit 17 to the sub-scanning feed deviation amount calculation device 94 of the print controller 80 is converted to binary values.

Thereupon, at step S210, the straight line equation calculation unit 94a calculates the equation of the first straight line (first line) 102-1*a* constituting the first test pattern 102-1. There are no particular restrictions on the method of calculating the straight line equation, and one of the simplest embodiments is a method where the coordinates of the binarized scanned image are input and the equation of the straight line is determined by a method of least squares. In this method, if there is a dot which is significantly distanced from the straight line, then this dot should be excluded when the equation of the straight line is determined. Furthermore, the image in the vicinity of the point of intersection between the two straight lines should be excluded from the calculation of the point of intersection, since it is difficult to judge which of the two straight lines the data relates to and this can give rise to errors. The equation of the first straight line thus calculated can be expressed as follows, for example: $y=\alpha_1 x+\beta_1$.

Thereupon, at step S220, the straight line equation calculation unit 94*a* calculates the equation of the second straight line (second line) 102-1*b* constituting the first test pattern 102-1. The equation of the second straight line thus calculated can be expressed as follows, for example: $y=\alpha_2 x+\beta_2$.

Thereupon, at step S230, the coordinates of the point of intersection of the two straight lines are calculated by solving the two straight line equations calculated as described above. The coordinates $(x_1, y_1)$ of the point of intersection of the two straight lines are determined by solving the simultaneous equations described below.

$$x_1=(\beta_2-\beta_1)/(\alpha_1-\alpha_2)$$

$$y_1=(\alpha_1\beta_2-\alpha_2\beta_1)/(\alpha_1-\alpha_2)$$

In a similar fashion to the description given above, the coordinates $(x_2, y_2)$ of the point of intersection of the two straight lines constituting the second test pattern 102-2 are also calculated.

In this case, since there is a plurality of nozzles (a sufficient number of nozzles) which eject droplets to form the dots that constitute the lines of the test patterns, then even if these nozzles include a nozzle suffering an ejection defect, it will have very little effect on the results. Furthermore, if there is random variation in the droplet ejection positions, then this has no effect and it is possible to determine a median straight line equation. In this way, even if there is variation in the ejection volume or even if an ejection defect nozzle is present, it is possible to determine the straight line equations accurately, without effects caused by such ejection volume variation or an ejection defect nozzle. Moreover, in a similar fashion, even if there is variation in the sensitivity of the sensors, since the dots which constitute the lines are measured by a plurality of sensor elements, then it is possible to determine the straight line equations accurately without being affected by variation in the sensitivity of the sensors. Consequently, since it is possible to determine the straight line equations accurately, it is possible to determine the coordinates of the points of intersection of the straight lines accurately.

Returning to step S150 in FIG. 4, the sub-scanning feed deviation amount calculation unit 94*c* calculates the sub-scanning feed amount, $y_2-y_1$, by comparing the y coordinates, $y_1$ and $y_2$, of the two points of intersection thus determined.

In this case, if the sub-scanning feed deviation amount $y_2-y_1$ is 0, then $y_2=y_1$ and there is no deviation in the sub-scanning feed amount. Furthermore, as shown in FIG. 11, if the sub-scanning feed deviation amount is $y_2-y_1>0$, then the differential between the y coordinates is equal to the amount of sub-scanning feed deviation.

In the embodiment described above, if there is no deviation in the sub-scanning feed, then the y coordinates of the points of intersection of the respective straight lines constituting the two test patterns recorded before and after feeding in the sub-scanning direction coincide with each other, but the calculation of sub-scanning feed deviation is not limited to an embodiment of this kind.

Figure 13:
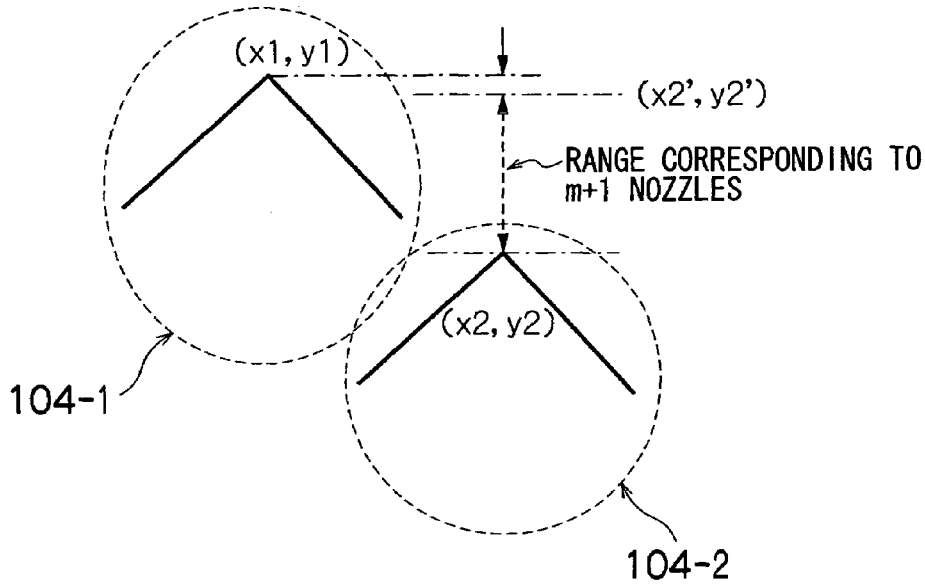
FIG. 13 is an illustrative diagram showing a further method of determining a sub-scanning feed deviation amount.

FIG. 13 shows another method of calculating the sub-scanning feed amount.

This method also uses a test pattern similar to that described above (see FIG. 5); however, if the length (height) in the y direction (sub-scanning direction) of the test pattern corresponds to m nozzles, then, after printing a test pattern in a first pass, the recording paper may be conveyed through a sub-scanning feed amount corresponding to m+1 nozzles, and the same test pattern may be printed in a second pass again by using m nozzles which have printed the test pattern in the first pass.

In this case, as shown in FIG. 13, it is possible to determine the sub-scanning feed deviation amount by comparing the y coordinate $y_1$ of the test pattern 104-1 printed in the first pass with the y coordinate $y_2'$ obtained by subtracting a length corresponding to m+1 nozzles from the y coordinate $y_2$ of the test pattern 104-2 printed in the second pass.

Furthermore, the test patterns printed in the first pass and the second pass before and after the sub-scanning feed action do not have to be the same, as described in these embodiments.

Figure 14A:
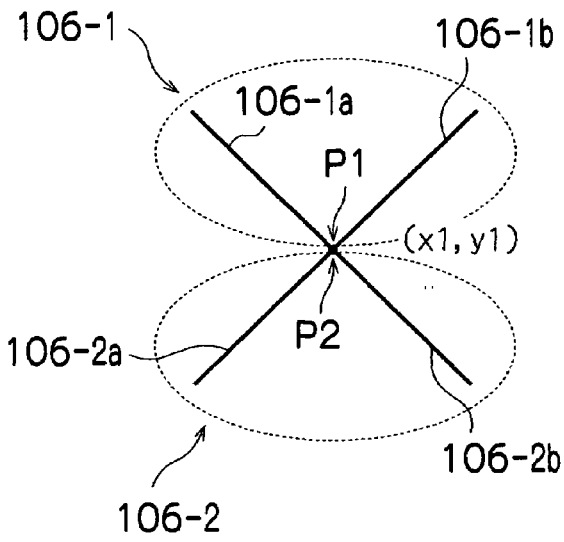
FIGS. 14A and 14B are illustrative diagrams showing yet a further method of determining a sub-scanning feed deviation amount.
Figure 14B:
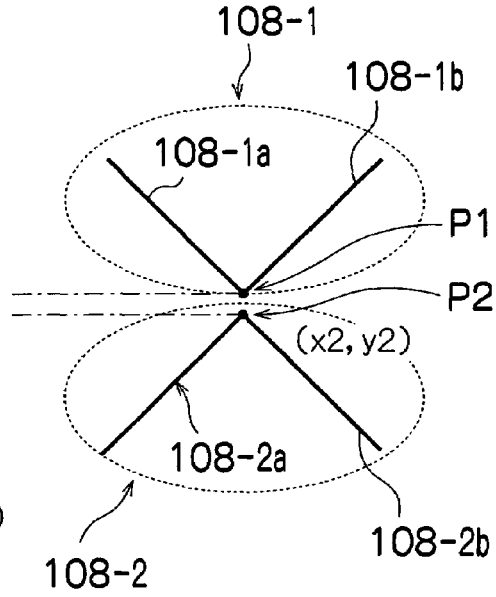

For instance, in the embodiment shown in FIGS. 14A and 14B, the test pattern printed in the first pass and the test pattern printed in the second pass after the sub-scanning feed action are patterns which are mutually reversed in the sub-scanning direction.

In the embodiment shown in FIG. 14A, after printing a V-shaped first test pattern 106-1 in a first pass, the medium is fed in the sub-scanning direction through a distance equivalent to the nozzles corresponding to the length (height) of the test pattern 106-1 minus a distance equivalent to one nozzle, whereupon a second test pattern 106-2 which has a shape of the V-shaped first test pattern 106-1 reversed in the sub-scanning direction is printed by the same nozzles as previous time, in a second pass.

In the embodiment shown in FIG. 14A, the point P1 of intersection of the two straight lines 106-1*a* and 106-1*b* constituting the first test pattern 106-1 coincides with the point P2 of intersection of the two straight lines 106-2*a* and 106-2*b* constituting the second test pattern 106-2, and in this case, the sub-scanning feed deviation amount is 0 and hence there is no sub-scanning feed deviation.

Furthermore, in the embodiment shown in FIG. 14B, in a similar fashion, after printing a V-shaped first test pattern 108-1 in a first pass, the medium is fed in the sub-scanning direction through a distance equivalent to the nozzles corresponding to the length (height) of the test pattern 108-1 minus a distance equivalent to one nozzle, whereupon a second test pattern 108-2 which has a shape of the V-shaped first test pattern 108-1 reversed in the sub-scanning direction is printed by the same nozzles as previous time, in a second pass.

In the embodiment shown in FIG. 14B, the point P1 of intersection of the two straight lines 108-1*a* and 108-1*b* constituting the first test pattern 108-1 is away from the point P2 of intersection of the two straight lines 108-2*a* and 108-2*b* constituting the second test pattern 108-2, and in this case, the differential between the y coordinates, $y_1-y_2$, gives the amount of sub-scanning feed deviation.

In this way, in the embodiment shown in FIGS. 14A and 14B, it is possible to visually ascertain whether or not the points of intersection of the two straight lines of the respective test patterns coincide with or separated from each other. Therefore, by using patterns of this kind, it is possible to judge whether or not there is deviation in the sub-scanning feed by visual inspection and by an automatic measurement using sensors.

The embodiments described above are embodiments where the sub-scanning feed amount is an integral multiple of the nozzle pitch, but needless to say, even in a case where the sub-scanning feed amount is not a multiple integer of the nozzle pitch, it is still possible to determine the sub-scanning feed deviation amount in a similar manner.

There follows descriptions of further beneficial effects of using a method of determining the sub-scanning feed deviation amount (recording medium conveyance amount measurement method) according to the present embodiments, and an application which utilizes these beneficial effects.

As stated previously, since the straight line equations are calculated by measuring the straight lines formed by droplets ejected from a plurality of nozzles by means of a plurality of sensor elements, then the straight lines pass through the center positions of the ideal ejected droplets, regardless of the size of the ejected droplets, and since the coordinates of the points of intersection of the straight lines and the amount of sub-scanning feed deviation which are determined on the basis of these, are determined with respect to the centers of the ejected droplets, then it is possible to determine the sub-scanning feed deviation amount with a high degree of accuracy.

In other words, although the size of the ejected droplets varies in accordance with the type of medium onto which the test pattern is printed, if the method of calculating the sub-scanning feed deviation amount according to the present embodiment is used, then it is possible to calculate a highly accurate sub-scanning feed deviation amount, regardless of the type of medium onto which the test pattern is printed.

Figure 15:
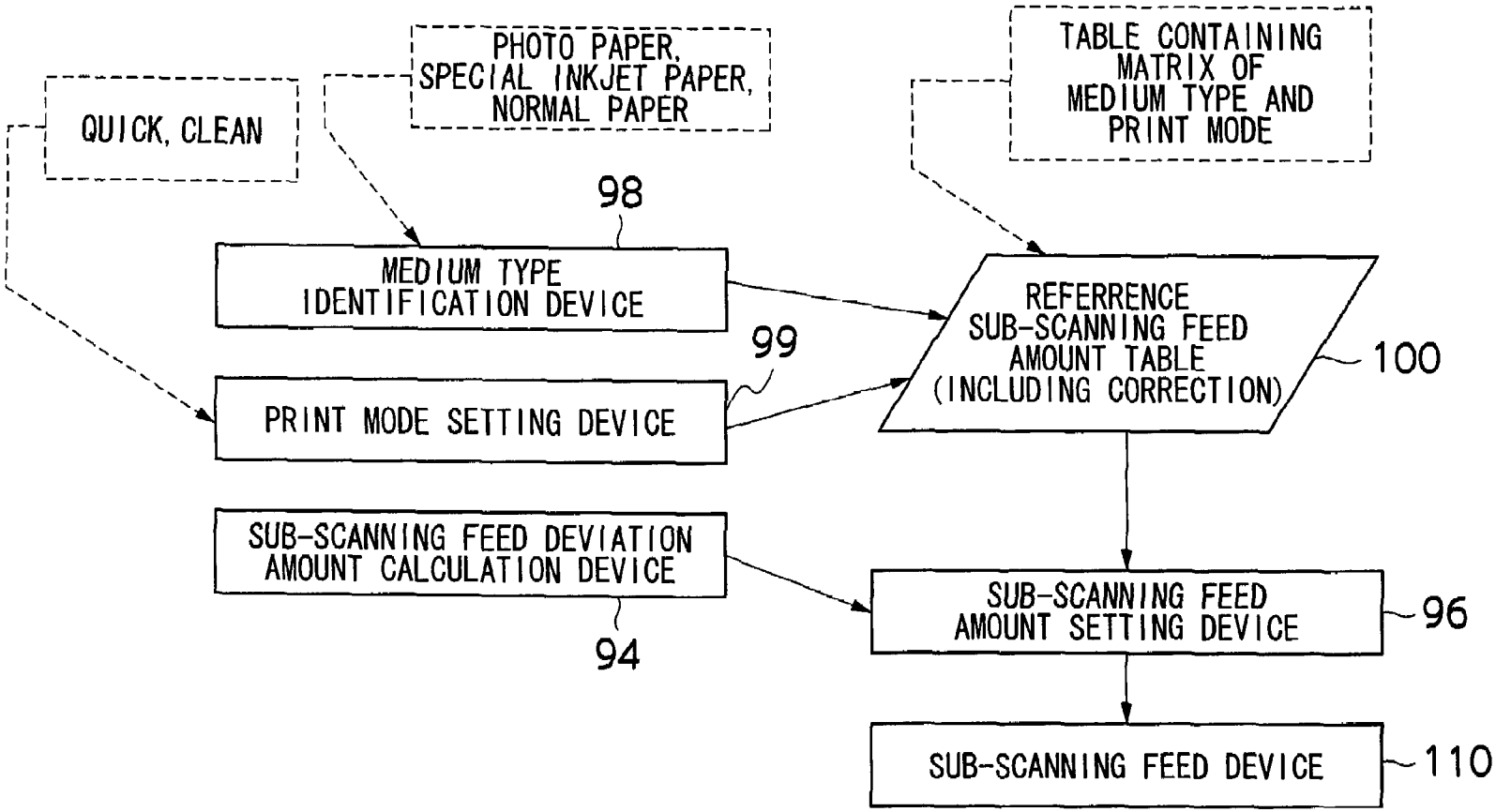
FIG. 15 is a block diagram relating to a sub-scanning feed operation in an inkjet recording apparatus which adopts a method of calculating the sub-scanning feed deviation amount according to an embodiment of the present invention.

FIG. 15 is a block diagram relating to a sub-scanning feed operation in an inkjet recording apparatus 10 which adopts a method of calculating the sub-scanning feed deviation amount according to the present embodiment. This diagram shows the portion which relates to the adoption of the method of calculating the sub-scanning feed deviation amount, as extracted from the control block diagram shown in FIG. 3.

As shown in FIG. 15, firstly, the medium type identification device 98 identifies whether the recording paper 16 is normal paper, photographic paper, special inkjet paper, or the like. Furthermore, the print mode setting device 99 sets the print mode to a print mode which prioritizes the printing speed, or a print mode which prioritizes clean printing, or the like.

On the other hand, the reference sub-scanning feed amount is selected on the basis of the identified or the set recording medium type and print mode, by using a reference sub-scanning feed amount table 100 in which corrected reference sub-scanning feed amounts are set previously in a matrix in combination with the recording medium type and the print mode.

The sub-scanning feed amount setting device 96 sets the sub-scanning feed amount by using the selected reference sub-scanning feed amount, and the sub-scanning feed deviation amount calculated by the sub-scanning feed deviation amount calculation device 94 according to the present embodiment as described above.

On the basis of the sub-scanning feed amount thus set, a prescribed sub-scanning feed is performed by a sub-scanning feed device 110, which includes the motor 77 that drives the suction belt conveyance unit 22 and the motor driver 76 that controls this motor 77 and the like. Consequently, whatever the type of medium used for printing the test pattern, sub-scanning feed is performed without the occurrence of sub-scanning feed deviation, for all types of medium, and it is possible to carry out high-precision image recording which does not give rise to banding unevenness, or the like, caused by sub-scanning feed deviation.

A recording medium conveyance amount measurement method and an inkjet recording apparatus according to the present invention have been described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording medium conveyance amount measurement method, comprising the steps of:

recording a first test pattern having two straight lines including at least one straight line which is not parallel with respect to a conveyance direction of a recording medium and is not parallel with a direction perpendicular to the conveyance direction, onto the recording medium;

conveying the recording medium in the conveyance direction;

recording a second test pattern having two straight lines including at least one straight line which is not parallel with respect to the conveyance direction of the recording medium and is not parallel with the direction perpendicular to the conveyance direction, onto the recording medium; and reading in the first and second test patterns and calculating a conveyance amount of the recording medium, wherein the first and second test patterns are mutually reversed in the conveyance direction.

2. The recording medium conveyance amount measurement method as defined in claim 1, wherein the conveyance amount of the recording medium is calculated by calculating a first intersection point of the two straight lines constituting the first test pattern and a second intersection point of the two straight lines constituting the second test pattern, and calculating a distance in the conveyance direction between the first and second intersection points.

3. The recording medium conveyance amount measurement method as defined in claim 1, wherein each straight line is not parallel with respect to the conveyance direction of the recording medium and is not parallel with the direction perpendicular to the conveyance direction.

4. The recording medium conveyance amount measurement method as defined in claim 1, wherein the two straight lines of the first test pattern are not mutually parallel and the two straight lines of the second test pattern are not mutually parallel.

5. The recording medium conveyance amount measurement method as defined in claim 1, further comprising:

recording a V-shaped first test pattern in a first pass;

feeding the recording medium in the conveyance direction through a distance equivalent to nozzles corresponding to a length of the first test pattern minus a distance equivalent to one nozzle after recording the V-shaped first test pattern; and recording the second test pattern having a shape of the V-shaped first pattern reversed in the conveyance direction by the same nozzles as previous time in a second pass.

6. An inkjet recording apparatus, comprising:

a conveyance device which conveys a recording medium;

an ejection device which ejects liquid toward the recording medium while moving in a direction perpendicular to a conveyance direction of the recording medium;

a test pattern generation device which generates a first test pattern and a second test pattern, each having two straight lines including at least one straight line which is not parallel with respect to the conveyance direction of the recording medium and is not parallel with a direction perpendicular to the conveyance direction;

a reading device which reads in the first test pattern and the second test pattern formed on the recording medium; and a feed deviation amount calculation device which calculates a feed deviation amount of the recording medium in the conveyance direction according to results of reading in the first test pattern and the second test pattern by the reading device, wherein the recording medium is conveyed in the conveyance direction after the first test pattern is formed on the recording medium, the second test pattern is then formed on the recording medium, and the feed deviation amount of the recording medium in the conveyance direction is calculated according to the results of reading in the first test pattern and the second test pattern, wherein the first and second test patterns are mutually reversed in the conveyance direction.

7. The inkjet recording apparatus as defined in claim 6, wherein the feed deviation amount calculation device calculates a first intersection point of the two straight lines constituting the first test pattern and a second intersection point of the two straight lines constituting the second test pattern according to the results of reading in the first test pattern and the second test pattern by the reading device, and calculates the feed deviation amount according to a distance in the conveyance direction between the first and second intersection points.

8. The inkjet recording apparatus as defined in claim 6, further comprising:

a medium type identification device which identifies a type of the recording medium;

a print mode setting device which sets a print mode; and a conveyance amount setting device which sets the conveyance amount of the recording medium according to the type of the recording medium, the print mode, and calculation results of the feed deviation amount calculation device.

9. The ink jet recording apparatus as defined in claim 6, wherein each straight line is not parallel with respect to the conveyance direction of the recording medium and is not parallel with the direction perpendicular to the conveyance direction.

10. The ink jet recording apparatus as defined in claim 6, wherein the two straight lines of the first test pattern are not mutually parallel and the two straight lines of the second test pattern are not mutually parallel.

11. The ink jet recording apparatus as defined in claim 6, wherein the test pattern generation device generates a V-shaped first test pattern in a first pass; and the conveyance device feeds the recording medium in the conveyance direction through a distance equivalent to nozzles corresponding to a length of the first test pattern minus a distance equivalent to one nozzle after generating the V-shaped first test pattern; and wherein the test pattern generation device generates the second test pattern having a shape of the V-shaped first pattern reversed in the conveyance direction by the same nozzles as previous time in a second pass.

12. An inkjet recording apparatus, comprising:

a conveyance device which conveys a recording medium;

an ejection device which ejects liquid toward the recording medium while moving in a direction perpendicular to a conveyance direction of the recording medium; and a test pattern generation device which generates a first test pattern and a second test pattern, each having two straight lines including at least one straight line which is not parallel with respect to the conveyance direction of the recording medium and is not parallel with a direction perpendicular to the conveyance direction, wherein the recording medium is conveyed in the conveyance direction after the first test pattern is formed on the recording medium, the second test pattern is then formed on the recording medium, and the first and second test patterns are mutually reversed in the conveyance direction.

* * * * *